United States Patent [19]

Miyazawa et al.

[11] 4,204,778

[45] May 27, 1980

[54] WIRE TYPE DOT PRINTER HEAD ASSEMBLY

[75] Inventors: Yoshinori Miyazawa; Yoshifumi Gomi, both of Shiojiri, Japan

[73] Assignees: Kabushiki Kaisha Suwa Seikosha, Tokyo; Shinshu Seiki, Nagano, both of Japan

[21] Appl. No.: 910,154

[22] Filed: May 26, 1978

[30] Foreign Application Priority Data

May 26, 1977 [JP] Japan ..... 52-61343

[51] Int. Cl.[2] ..... B41J 3/12

[52] U.S. Cl. ..... 400/124; 101/93.05

[58] Field of Search ..... 400/124; 101/93.05; 335/274

[56] References Cited

U.S. PATENT DOCUMENTS

| | | | |
|---|---|---|---|
| 3,842,955 | 10/1974 | Iwasaki | 400/124 |
| 3,876,050 | 4/1975 | Linder | 400/124 |
| 3,991,869 | 11/1976 | Berry | 400/124 |
| 3,994,381 | 11/1976 | Hebert | 101/93.05 X |

FOREIGN PATENT DOCUMENTS

| | | | |
|---|---|---|---|
| 1254388 | 11/1967 | Fed. Rep. of Germany | 400/124 |
| 2449235 | 6/1975 | Fed. Rep. of Germany | 400/124 |
| 1577409 | 8/1969 | France | 400/124 |

*Primary Examiner*—Paul T. Sewell

*Attorney, Agent, or Firm*—Blum, Kaplan, Friedman, Silberman & Beran

[57] ABSTRACT

A printer head for a wire type dot printer including a plurality of printing wires driven by engagement at the input end of the wire with a clapper which is pivoted by a solenoid is provided. The printer head includes a plurality of clappers mounted on the free end of a deflected cantilever, each clapper driven by an electromagnet spaced about the center of the printer head. The clapper is returned to its standby position due to the moment arising at the free end of the cantilever.

6 Claims, 4 Drawing Figures

WIRE TYPE DOT PRINTER HEAD ASSEMBLY

BACKGROUND OF THE INVENTION

In conventional clapper type dot printer heads, a plurality of electromagnets are arranged in circular fashion about the central axis of the printer head. The same number of clappers are provided as electromagnets, the free end of the clapper engaging the input end of the printing wires, the other end of the clapper being its fulcrum. A turning force imparted to the clapper about its fulcrum is imparted to the printing wire by attracting the clapper or an attraction piece fixed thereon by the electromagnet. The printing wires engaged by the free end of the clappers are thrust outwardly in a printing direction.

Previously, one coil spring was used for each clapper to exert a biasing force thereon for returning it to its original standby position. Consequently, there were a large number of individual components and during assembly of the printer head, it was necessary to position each spring and clapper properly at its fulcrum and provide means for regulating the displacement of the clapper so as to maintain each clapper in an engaged position with the input end of each printing wire. For these reasons, the conventional printer heads included a large number of components, involved a complex construction providing great difficulties in assemblying the printer head. In addition, a large energy loss occurred due to friction between these various components. Accordingly, it is desirable to provide a wire type dot printer head including a plurality of clappers of simplified construction which would bias the clappers to their standby position and avoid the assembly problems noted above with respect to positioning the clappers and overcome the problems encountered in conventional dot printer heads.

SUMMARY OF THE INVENTION

Generally speaking, in accordance with the invention, an improved wire type dot printer head assembly is provided. The printer head assembly includes a plurality of printing wires which print on a recording medium when driven in a printing direction by engagement with the free end of a clapper displaced about its fulcrum by an electromagnet mounted on the printer head. The print end of the wires are aligned in a line and printing is accomplished by selectively thrusting out print wires in response to print signals as the printer head or recording medium is displaced. A plurality of electromagnets are mounted at the circumference of the printer head and clappers driven by the electromagnets pivot about a fulcrum proximate the periphery of the frame. Each clapper is mounted on the free end of cantilever leaf spring arm of a leaf spring formed with a central mounting portion for mounting at the central axis of the printer head. The cantilever maintains engagement between the free ends of the clappers and the input ends of the print wires and the clappers are biased to their standby position after printing by the moment arising at the fulcrum end of the clapper due to the inclination formed between the cantilever portion of the leaf spring arm in the leaf spring body. The print wires are maintained in engagement with the free end of the clappers during return by a coil return spring.

Accordingly, it is an object of the invention to provide an improved wire type dot printer head assembly.

Another object of the invention is to provide an improved clapper-type wire dot printer head assembly of simplified construction and readily adaptable to miniaturization.

A further object of the invention is to provide an improved clapper type wire dot printer head assembly wherein the clappers are maintained biased towards their standby position by mounting each clapper at its fulcrum end to the free end of a cantilever type leaf spring.

Still another object of the invention is to provide an improved clapper type wire dot printer having an improved cantilever type leaf-spring mounting at the center of the printer head inside the electromagnets.

Still another object of the invention is to provide a wire type dot printer head of simplified construction wherein the number of components is reduced and assembly of the clappers during assembly of the printing head is simplified.

Still other objects and advantages of the invention will in part be obvious and will in part be apparent from the specification.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
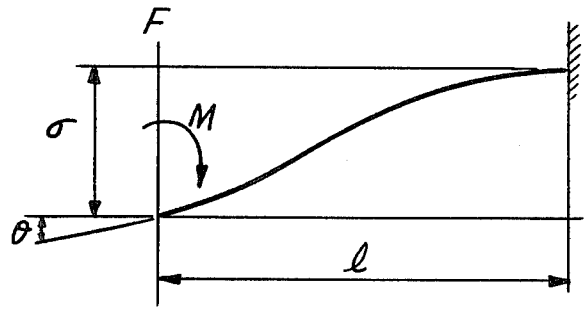
FIG. 1 is a graphical representation showing the characteristics of a leaf spring in a wire type dot printer head constructed and arranged in accordance with the invention.

Referring specifically to FIG. 1, the theoretical relationship between displacement of the end of a leaf spring and the effective length of the leaf spring is shown. In the graph, l represents the effective length of the leaf spring; sigma ($\sigma$) represents the displacement at the free end thereof; theta ($\theta$) represents the inclination at the free end thereof; F denotes the force applied to the free end thereof; and M denotes the moment applied to the end thereof. Accordingly, based on the following well known strength of material formulas:

$$F=K_1\sigma-K_2\theta$$

$$M=K_3\sigma-K_4\theta.$$

By fixing sigma at a constant value, the inclination at the end of the leaf spring is balanced at the value $\theta_0=(K_3/K_4)\sigma$ and when the spring is in any other position, a moment arises at the free end. Accordingly, if a clapper is fixed to the free end of a leaf spring, the clapper will always be biased towards the original inclined position of the leaf spring as will be more fully described herein.

Figure 2:
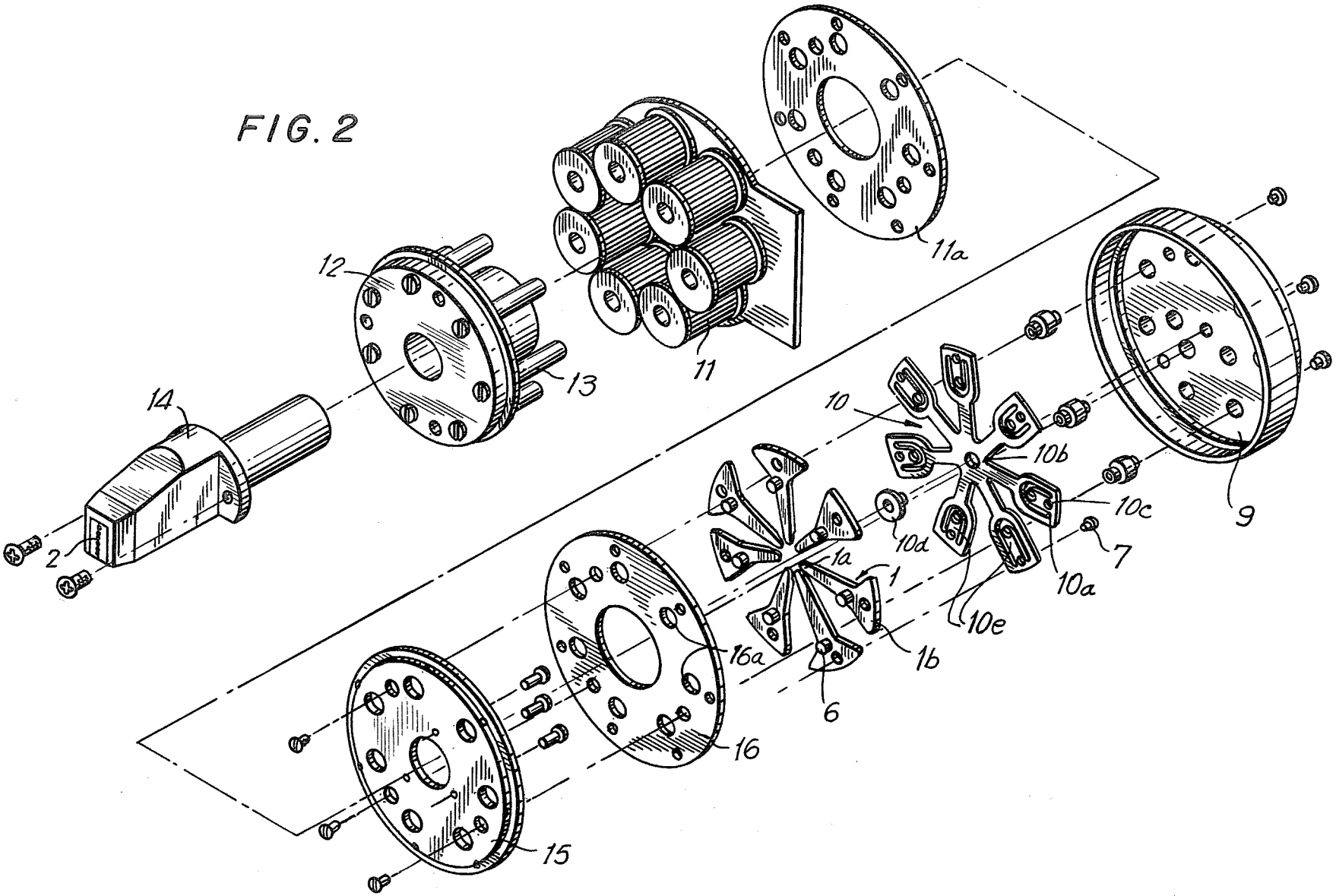
FIG. 2 is an exploded perspective view of a clapper type wire dot printer head constructed and arranged in accordance with the invention.
Figure 3:
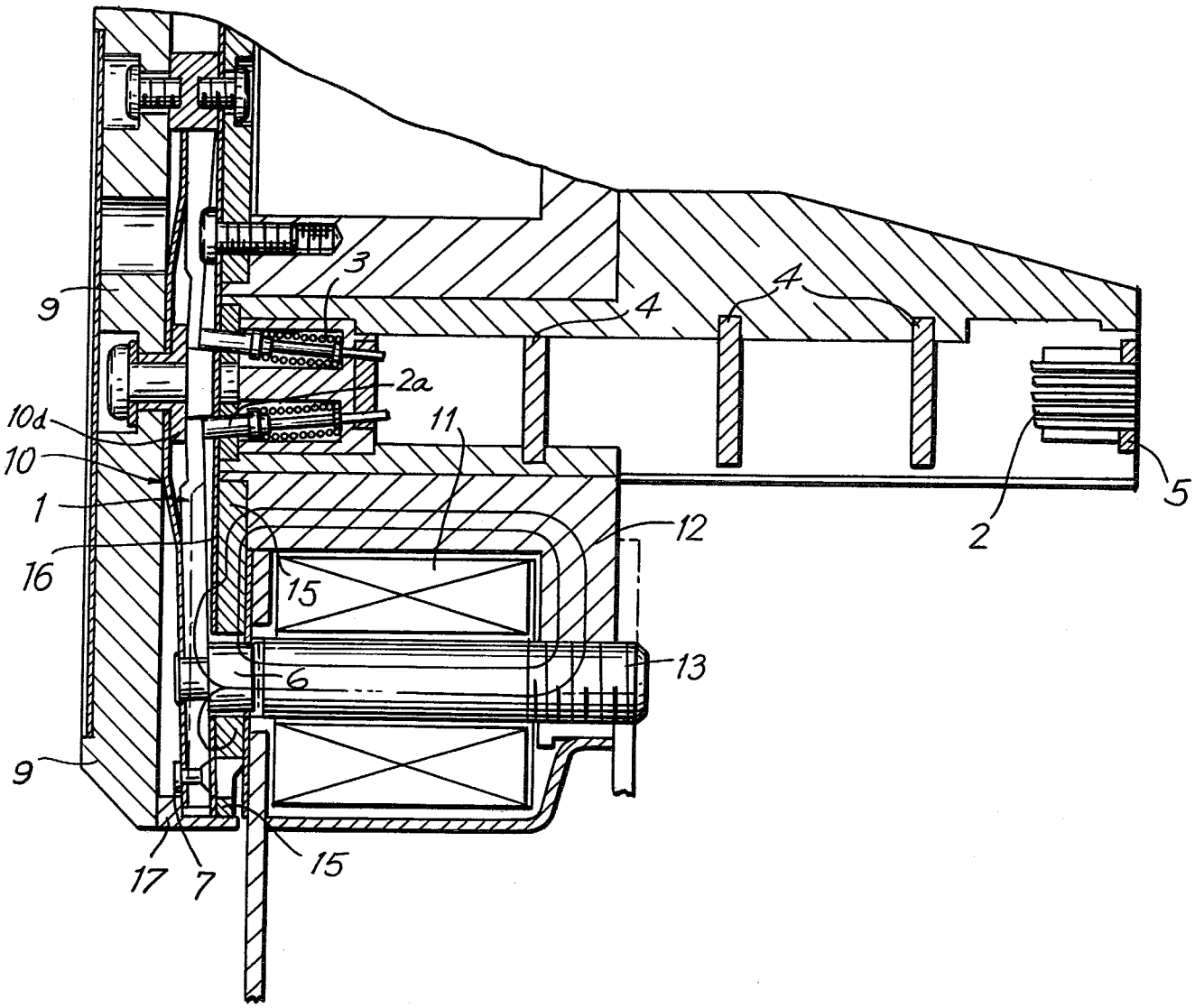
FIG. 3 is a partial sectional view of a clapper type wire dot printer head illustrated in FIG. 2.

Referring now to FIGS. 2 and 3, a clapper type wire dot printer head constructed and arranged in accordance with the invention, is shown in exploded perspective and sectional views, respectively. In both figures, the same elements are denoted by the same reference numerals. The printer head is an elongated assembly having a central axis and hollow core through which a plurality of printing wires 2 are disposed. A nose 14 having a nose guide 5 is secured to a circular yoke 12 having a plurality of iron cores 13 perpendicularly mounted thereon for inserting into the hollow cores of a corresponding number of electromagnets 11 mounted in circular fashion. A circular spacer plate 11*a* is mounted on electromagnets 11 and a yoke plate 15 is mounted to the central portion of yoke 12 for securing electromagnets 11 therebetween. A non-magnetic spacer 16 is mounted over yoke plate 15 for preventing any effect of residual magnetism upon the printing mechanism.

A plurality of clappers or operating plates 1 corresponding to the number of print wires 2 and electromagnets 11 are each mounted on a leaf spring 10 by a rivet 7. Each clapper 1 is an elongated lever formed with a print end 1*a* adapted to engage the input end of wire 2 in a print direction and a fulcrum end 1*b* for pivoting clapper 1. A projecting iron plunger 6 is mounted on each clapper 1 and each plunger 6 is adapted to project through an opening 16*a* formed in non-magnetic spacer 16 for the selective attraction by iron cores 13 of electromagnets 11. Each clapper 1 is mounted on a cantilever arm 10*a* of a leaf spring 10 by rivet 7 at the fulcrum end 1*b* of clapper 1.

Leaf spring 10 is substantially circular and formed with cantilever arms 10*a* extending radially from a central mounting portion 10*b*. The free end of each cantilever arm 10*a* includes a leaf spring finger 10*e* extending towards the central axis formed with a mounting opening 10*c* for rivet 7 for mounting clapper 1 thereon. Leaf spring 10 with clappers 1 mounted thereon is secured in the printer head between spacer 16 and a stopper plate 9 at mounting position 10 by a mounting washer 10*d*. Stopper plate 9 is formed with a laterally extending fulcrum arrester 17 adapted to provide a fulcrum at the free end of cantilever leaf spring arms 10*a* at the outer periphery of the printer head for providing a moment to clappers 1 at fulcrum end 1*b* as will be more fully described below with respect to operation of the printer head in connection with FIG. 3.

Referring specifically to FIG. 3, each print wire 2 is positioned through the core of the printer head by nose guide 5 and a series of intermediate guides 4. As shown, fulcrum end 1*b* of clapper 1 is held at the periphery of yoke plate 15 by fulcrum arrester 17 with print end 1*a* of clapper 1 engaged with the input end of print wire 2 by a print wire head 2*a*. In the rest or standby position, as shown, print end 1*a* of clapper 1 is biased against wahser 10*d* which is fitted into the central portion of stopper plate 9. Washer 10*d* also secures mounting portion 10*b* of leaf spring 10 to stopper plate 9. Each print wire 2 is biased towards its standby position by a print wire reset spring 3.

Figure 4:
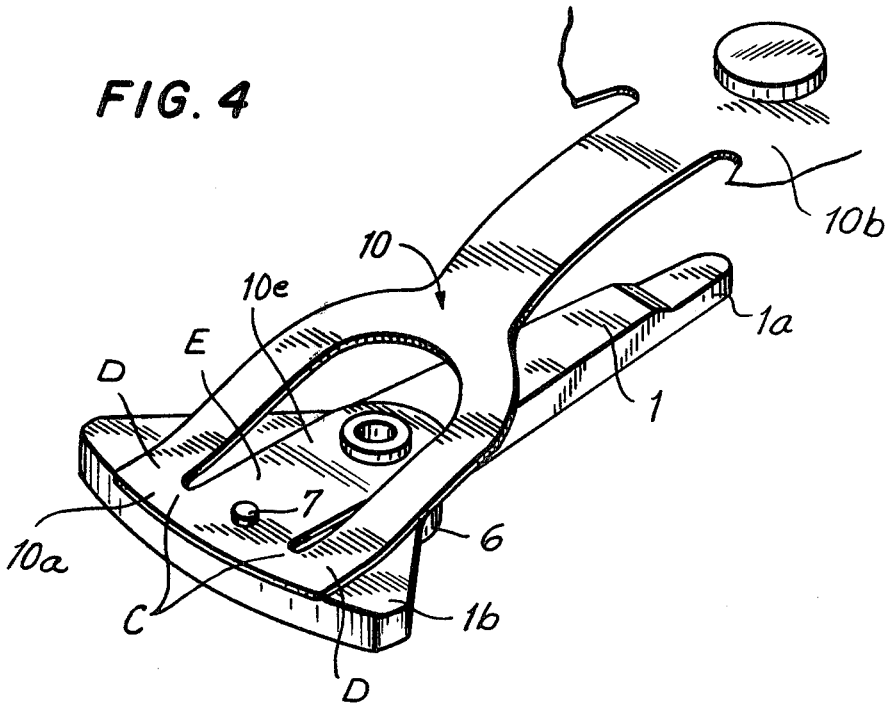
FIG. 4 is a partial perspective view of a cantilever leaf spring arm of a leaf spring utilized in the clapper type wire dot printer head illustrated in FIGS. 2 and 3.

When clapper 1 is in a standby position it is inclined towards stopper plate 9 from fulcrum end 1*b*. As shown in FIG. 4, cantilever arm 10*a* of leaf spring 10 has the same inclination as clapper 1 in the region E where clapper 1 is fixed to cantilever arm 10*a*. In the region C, a shearing force acts to provide an inclination in the region D the same as the inclination in region E. With a moment arising at the free ends of cantilever arms 10*a* due to this inclination, clappers 1 attached thereto are subjected to a moment in the direction towards stopper plate 9 such that print ends 1*a* are pressed against washer 10*d*. Thus, clappers 1 are biased towards their at rest or standby position.

The wire dot printer is operated as follows. When a current is selectively applied to selected electromagnets 11 as a result of a printing instruction from a print control means (not shown), the magnetic flux produced by electromagnet 11 passes through iron cores 13 and corresponding selected attracted iron pieces 6 disposed on clappers 1 are attracted to iron cores 13. Clapper 1 is pivoted from its first at rest position about fulcrum end 1*b* to its second print position for driving print wire 2 engaged at print end 1*a* towards a recording medium (not shown) disposed proximate nose 14. After the printing instruction is accomplished, the current is shutoff and clapper 1 returns to its first at rest position due to the moment imparted by cantilever arm 10*a*. Print wire 2 returns to its first at rest position due to the biasing force of print wire reset spring 3 and is maintained in engagement with print end 1*a* of clapper 1 when it returns to its first standby position.

By constructing a wire dot printer head having a cantilever type leaf spring constructed and arranged in accordance with the invention wherein clappers are mounted thereon at the free end of the cantilever arms, it is possible to provide a biasing means for returning the clappers to their standby position. The leaf spring may be mounted on the center side of the circle defining the position of electromagnets. By doing so it is possible to reduce the number of components in a printer head, miniaturize the construction and avoid the energy loss associated with the prior art construction.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A wire dot type printer comprising:

a printer head having a hollow central core;

a plurality of print wires slideably mounted in said central core;

a plurality of selectively operable solenoid means disposed about the central core;

clapper means operatively coupled between said print wires and said solenoid means for selectively displacing said print wires between a first at rest position and a second printing position;

biasing means for biasing said clapper means towards the at rest position after completion of printing, said clapper means mounted on said biasing means; and biasing means mounted to said printer head at the axis of the hollow central core, and having a cantilever leaf spring having a central mounting portion and a plurality of radially extending cantilever arms, each arm formed with a leaf spring at the free end thereof with an internal leaf finger extending towards the central axis with said clapper means mounted on said cantilever leaf spring finger.

2. The printer of claim 1, wherein said clapper means are elongated clapper levers, each lever formed with a print end for engaging the input end of one of said print wires and a fulcrum end, each said clapper lever mounted to the free end of one of said cantilever leaf spring arms.

3. The printer of claim 2, wherein the first and second leaves of said leaf springs are inclined with respect to each other to form an angle therebetween at their at rest position, said clapper lever mounted on said second leaf and inclined towards the input end of said print wire.

4. The printer of claim 3, wherein said angle between said first and second leaf is acute.

5. The printer of claim 3, wherein an attracted iron plunger is mounted on said clapper lever for displacing said clapper lever and print wire in response to a current applied to said solenoid means.

6. The printer of claim 5, wherein said printer includes seven print wires, seven solenoid means disposed about the circumference of said print head and said leaf spring has seven cantilever arms adapted to overlie said solenoid means, and seven clapper levers mounted on said cantilever arms.

* * * * *